US005161391A

United States Patent [19]

Lorberfeld

[11] Patent Number: 5,161,391

[45] Date of Patent: Nov. 10, 1992

[54] VARIABLE CONFIGURATION EARRING

[76] Inventor: Marcia Lorberfeld, 500 E. 77th St., New York, N.Y. 10021

[21] Appl. No.: 581,009

[22] Filed: Sep. 12, 1990

[51] Int. Cl.[5] ..... A44C 7/00

[52] U.S. Cl. ..... 63/13; 63/14.2

[58] Field of Search ..... 63/13, 12, 1.1, 14.2, 63/14.1, 14.6, 14.8

[56] References Cited

U.S. PATENT DOCUMENTS

| | | | |
|---|---|---|---|
| 130,771 | 8/1872 | Tryner | 63/13 |
| 2,526,087 | 10/1950 | Schodman et al. | 63/14.2 |
| 2,764,000 | 9/1956 | Cippmann | 63/14.2 |

FOREIGN PATENT DOCUMENTS

| | | | |
|---|---|---|---|
| 907214 | 6/1945 | France | 63/13 |
| 582658 | 11/1946 | United Kingdom | 63/14.2 |

*Primary Examiner*—Laurie K. Cranmer

*Attorney, Agent, or Firm*—Handal & Morofsky

[57] ABSTRACT

A variable configuration is disclosed. The variable configuration aspect of the earing allows the appearance of the earring to be altered at will by the wearer. This adaptability allows appropriate variations of the earring to be worn on differing occasions for differing functions. The earring also mimics the appearance of a plurality of separate earrings worn together.

11 Claims, 6 Drawing Sheets

VARIABLE CONFIGURATION EARRING

BACKGROUND

Ear lobes been pierced for the insertion of earrings since prehistoric times and earrings have been a basic part of adornment throughout recorded history. Ancient Egyptians favored a gold hoop which later gave way to pendant earrings. Ancient goldsmiths independently created works of great detail and delicacy in the various early cultures associated with the cradles of civilization.

Fashion dictates size and length of the earrings whether the form is a stud, hoop, sphere, chain, religious symbol, animal or whatever. Different materials and colors may also be dictated by fashions.

Men have historically worn earrings and continue to do so. In the East, earrings once denoted a man's rank. Pirates and other seamen have traditionally worn gold earrings, reportedly to cover burial expenses if they die away from home. During the Renaissance men commonly adorned themselves with earrings and the practice of males wearing earrings is again becoming popular with the young today.

The screw-clasp brought a revival to the wearing of earrings around 1900 and clip-ons have also encouraged the use of earrings.

Today, most people wearing earrings opt for piercing their ears and it is not uncommon to see pre-school girls with pierced ears.

Current fashion embraces multiple piercing, allowing a person to wear two or more pair of earrings simultaneously. However, if not used, the additional holes pierced in an ear will close up.

Large earrings are also favored in the current fashions and trends. Unfortunately, large earrings are also prone to be heavy. Heavy earrings can put pressure on a pierced ear causing pain. Clip-one currently capable of holding heavy earrings to an ear, along with screw clasps on heavy earrings, cause a painful pinch.

SUMMARY OF THE INVENTION

The inventive earring offers several advantages over the many styles and types of earrings available. The inventive earring is capable of changing its appearance allowing the earring to function as several separate earrings. The inventive earring is further able to appear to be several separate earrings at the same time, giving the impression of multiply pierced ears. Additionally, the inventive earring is capable of distributing over an ear the pressure normally placed on a particular spot, i.e., and pierced hold, caused by an earring's weight.

BRIEF DESCRIPTION OF THE DRAWINGS

One way of carrying out the invention is described in detail below with reference to drawings which illustrate only one specific embodiment of the invention and in which.

BEST MODE FOR CARRYING OUT THE INVENTION

Figure 1:
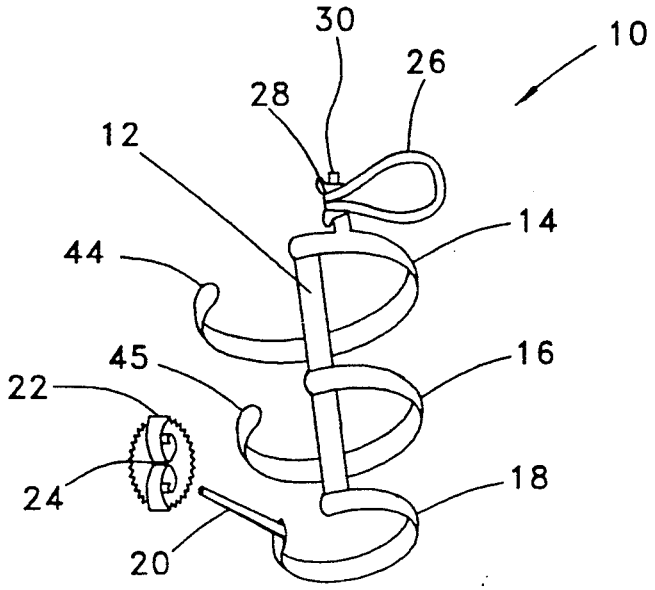
FIG. 1 is a perspective view of the basic earring spine and ribs and the clasp.
Figure 2:
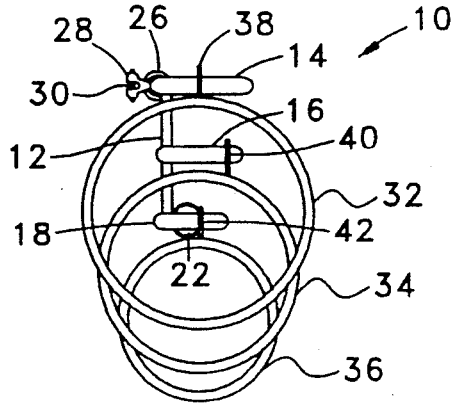
FIG. 2 is a side view of the basic earring including ornaments.
Figure 3:
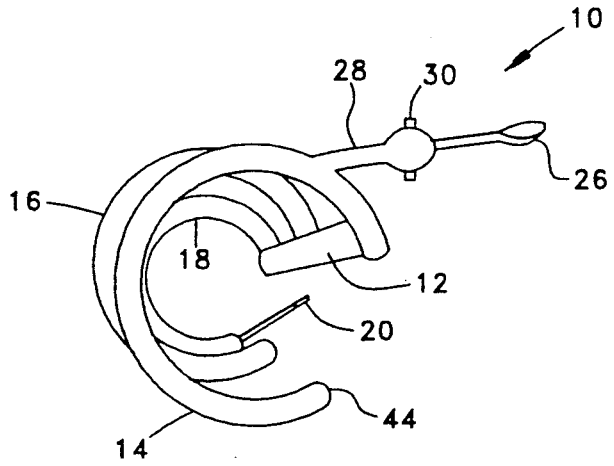
FIG. 3 is a top view of the basic earring.
Figure 4:
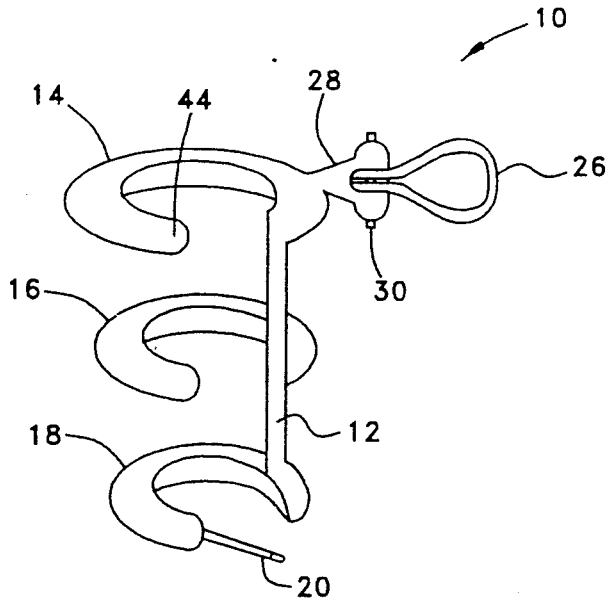
FIG. 4 is a back view of the basic earring.

Referring to FIGS. 1–4, inventive earring 10 is comprised of main spine member 12, first rib member 14, second rib member 16, and third rib member 18. Third rib member 18 terminates in ear post 20. Inventive earring 10 is held in place on wearer's lower ear through the action of clasp 22 and ear post 20. Clip 26 is pivotally mounted on clip mount 28 of first rib member 14. Retaining pin 30 rotatably attaches clip 26 to clip mount 28. Clip 26 is positioned and adapted to hold inventive earring 10 in place on wearer's ear by squeezing wearer's ear between clip 26 and first rib member 14. Ornaments, such as first hoop 32, second hoop 34, and third hoop 36 may be associated with first rib member 14, second rib member 16, and third rib member 18 respectively as shown in FIG. 2. First hoop 32 has first ring 38 integrally attached to it. First hoop 32 may be slidably mounted on first rib member 14 by first ring 38. Second hoop 34 has second ring 42 integrally attached. Similarly, third hoop 36 has third ring 42 integrally attached to it. Third hoop 36 may be slidably mounted on third rib member 18 by third ring 42. Rib members are substantially complete loops with one end attached to the spine member and the other end curving back towards the spine leaving a gap approximately 2 to 8 mm to accommodate the ear helix when the earring is worn. The gaps must be generally aligned for each to accommodate the ear.

Figure 5:
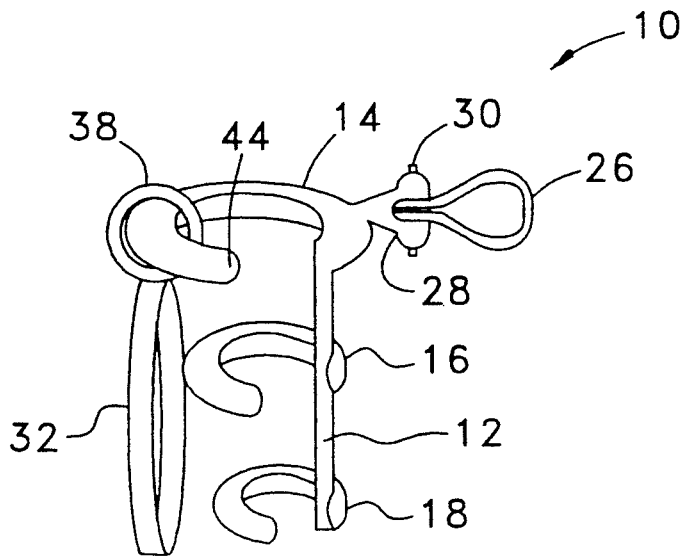
FIG. 5 is a back view of the basic earring and a single ornament.

Referring to FIG. 5, first hoop 32 has first ring 38 integrally attached to it. First ring 3 is adapted to accept free end 44 of first rib member 14 and slidably mounts first hoop 32 to first rib member 14. Similarly, second hoop 34 may be slidably mounted to second rib member 16 and third hoop 36 may be slidably mounted to third rib member 18. Free ends 44 and 45 are to contact the ear if an impression of multiple separate earrings is desired.

Figure 6:
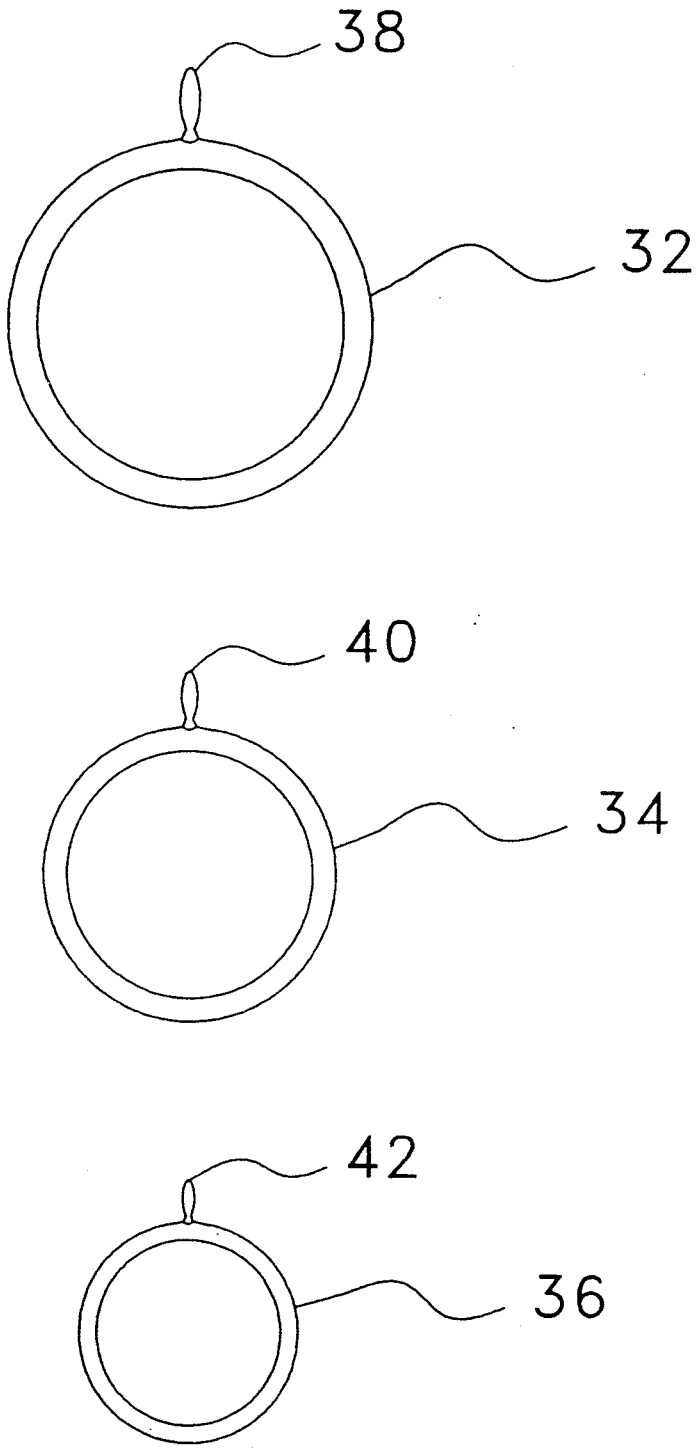
FIG. 6 shows three ornaments.

FIG. 6 illustrates first hoop 32, second hoop 34, and third hoop 36. First hoop 32 has first ring 38 integrally attached and is larger than second hoop 34. Second hoop 34 has second ring 40 integrally attached and is larger than third hoop 36. Third hoop 36 has third ring of 42 integrally attached.

Figure 7:
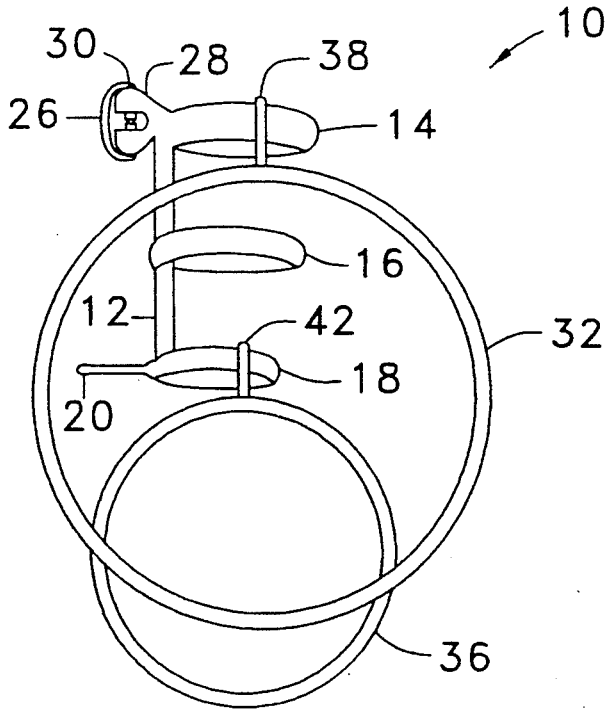
FIG. 7 is a side view of the basic earring with two ornaments.

FIG. 7 illustrates one of a variety of configurations of the inventive earring 10. In FIG. 7, first hoop 32 is slidably attached to first rib member 14 and third hoop 36 is slidably attached to third rib member 18, while second rib member 16 has no hoop slidably attached. Similarly, a variety of configurations can be assembled to vary the look of the inventive earring 10. Any one of the hoops, 32, 34, or 36 may be attached to any one of the rib members 14, 16, or 18. The inventive earring 10 can have any combination of two hoops of 32, 34 and 36, on any two rib members or can have none of the hoops 32, 34, or 36 attached to any of the rib members 14, 16, or 18.

Figure 8:
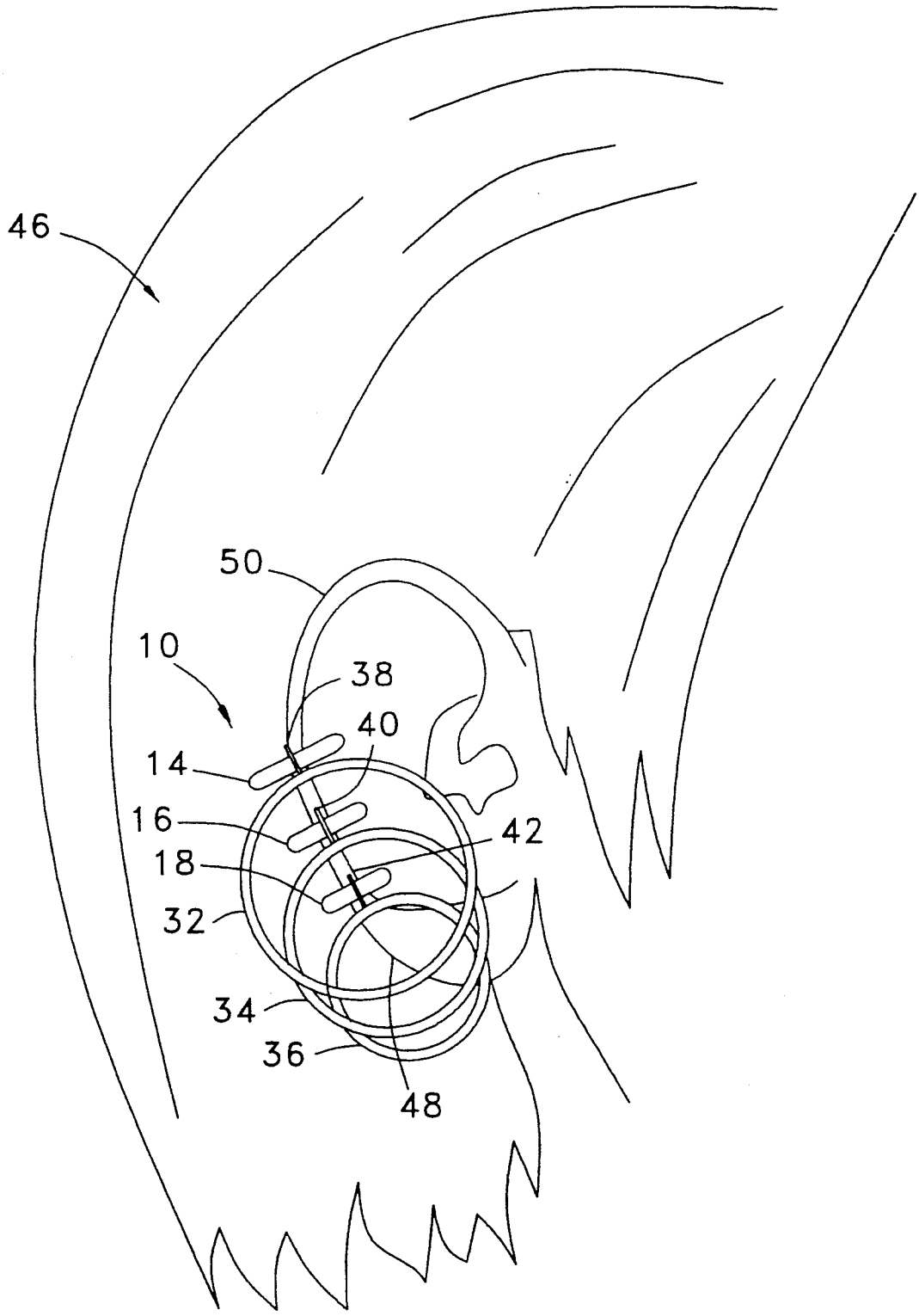
FIG. 8 is a side view of the earring as worn with three ornaments.

FIG. 8 illustrates the inventive earring 10 as intended to be used. Wearer 46 slips ear post 20 through a hole pierced in Wearer's lower ear 48. Clip 26 squeezes wearer's upper ear 50 between clip 26 and first rib member 14. Main spine member 12, clip 26 and clasp 22 are hidden from view by wearer's ear 52. The rib members 14, 16 and 18 appear to be separate earrings and produce an unusual effect as rib members 14 and 16 are not contacting the ear on the lobe, but within the helix of the ear.

In use, clasp 26 not only keeps the earring upright, it can help support the earring, partially relieving the lode on the pierced hole that ear post 20 passes through. Frictional contact between rib 16 and the ear may be adjusted also.

Figure 9:
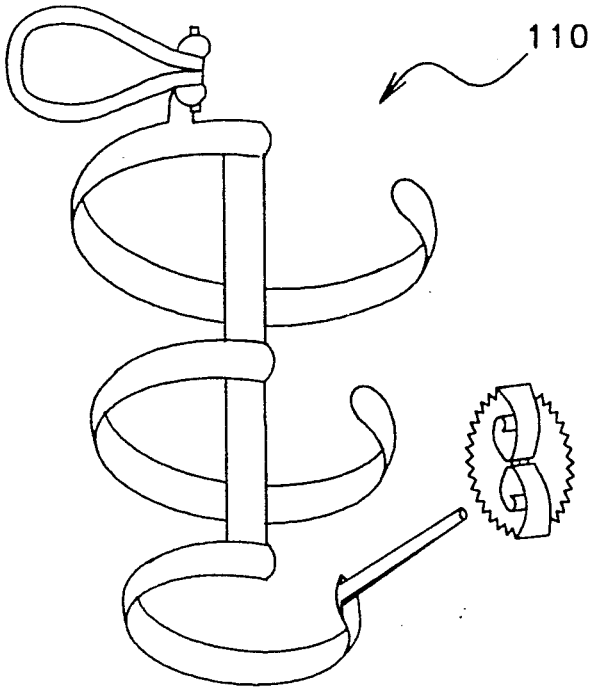
FIG. 9 is a perspective view of the mate to FIG. 1.
Figure 10:
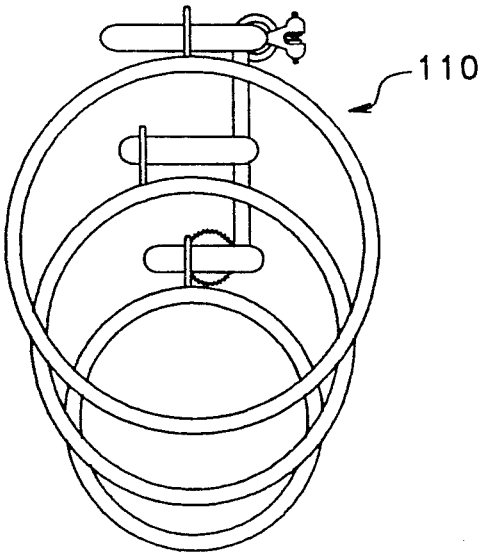
FIG. 10 is a side view of the mate to FIG. 1, with ornaments.

FIGS. 9 and 10 show two views, analogous to FIGS. 1 and 2, of the mate 110 to earring 10 depicted in FIGS. 1 to 5, 7 and 8. Earring 110 is a mirror image of earring 10.

Thus, wearing earrings 10 and 110 can produce a balanced, symmetrical look that is generally sought, yet offers the ability to achieve an eccentric look by varying the configuration of each earring independent of the other.

While the inventive earrings may be made from a variety of materials, a malleable metal is preferable.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A variable configuration earring comprising:

a) a spine member;

b) a plurality of rib members individually attached along said spine member, said rib members each forming a nearly complete loop with a body and two ends, said two ends defining a circumfernetial opening and said rib members arranged along said spine member such that there are two terminal rib members, one at each end of said spine, and such that the circumfernetial openings of each rib member are generally aligned, said plurality of rib members being arranged along said spine member such that said circumfernetial openings define a line substantially parallel to said spine member;

c) an ear post member attached to said variable configuration earring and a clasp for matingly engaging said ear post member; and d) a movable clip arm mounted on aide variable configuration earring and positioned at a point located a substantial distance from said ear post member, said clip arm being configured, and dimensioned to frictionally clasp, in a clasping position, an ear between said clip arm and said earring at said point and movable from said clasping position to a position out of engagement with said ear.

2. A variable configuration earring as claimed in claim 1, further comprising removable ornaments configured to be attached to said plurality of rib members.

3. A variable configuration earring as claimed in claim 1, wherein said ear post member is attached to the end of one of said terminal rib members farthest from said spine.

4. A variable configuration earring as claimed in claim 3, wherein said clip arm is mounted on the other terminal rib member.

5. A variable configuration earing as claimed in claim 4, wherein said clip arm is mounted near the end of said other terminal rib member nearest said spine to clasp an ear between said clip arm and the end of said terminal rib member farthest from said spine.

6. A variable configuration earring as claimed in claim 5, wherein said clip arm is mounted on a clip mounting member attached to said other terminal rib member.

7. A variable configuration earring as claimed in claim 1, wherein removable ornaments associated with said plurality of rib members are removably mounted on one of said rib members by an attached ring member.

8. A variable configurations earring as claimed in claim 7, wherein said removable ornaments are hoops.

9. A variable configuration earring as claimed in claim 8, wherein said removable ornaments comprise three differeingly sized hoops.

10. A variable configuration earring as claimed in claim 1, wherein said plurality of rib members comprises three rib members.

11. A pair of variable configuration earrings comprising an earring as claimed in claim 1 and a mirror image earring.

* * * * *